US007586454B2

(12) United States Patent
Morin et al.

(10) Patent No.: US 7,586,454 B2
(45) Date of Patent: Sep. 8, 2009

(54) METHOD OF ASSEMBLING A RADIOCOMMUNICATION ANTENNA, RADIOCOMMUNICATION ANTENNA ASSEMBLED BY SUCH A METHOD, AND DEVICE ADAPTED TO IMPLEMENT SUCH AN ASSEMBLY METHOD

(75) Inventors: Daniel Morin, Pornichet (FR); Armel Le Bayon, Saint Nazaire (FR); Denis Tuau, Trignac (FR); Michel Devicque, Guerande (FR)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 11/612,188

(22) Filed: Dec. 18, 2006

(65) Prior Publication Data

US 2007/0152899 A1 Jul. 5, 2007

(30) Foreign Application Priority Data

Dec. 19, 2005 (FR) ..... 05 53937

(51) Int. Cl.
*H01Q 13/00* (2006.01)

(52) U.S. Cl. ..... 343/781 P; 343/772

(58) Field of Classification Search ..... 343/781 P, 343/781 CA, 781 R, 772
See application file for complete search history.

(56) References Cited

U.S. PATENT DOCUMENTS

| | | | | |
|---|---|---|---|---|
| 3,827,051 | A | 7/1974 | Foldes | |
| 4,599,744 | A | 7/1986 | Vaughan | |
| 5,086,303 | A * | 2/1992 | Usui et al. | 343/756 |
| 5,229,736 | A | 7/1993 | Adams et al. | |
| 6,107,973 | A * | 8/2000 | Knop et al. | 343/781 P |
| 6,137,449 | A * | 10/2000 | Kildal | 343/781 P |
| 6,724,349 | B1 * | 4/2004 | Baird et al. | 343/781 CA |

* cited by examiner

*Primary Examiner*—Hoang V Nguyen
(74) *Attorney, Agent, or Firm*—Sughrue Mion, PLLC

(57) ABSTRACT

The present invention relates to a method of assembling a radiocommunication antenna comprising a reflector connected to a subreflector via a circular section waveguide extending along a longitudinal axis. According to the invention, such a method comprises the following steps:

the step of pivoting the waveguide about its longitudinal axis to determine a position such that an offset of the plane of propagation of a polarized electromagnetic field transmitted by this guide is limited, the step of marking this position on the waveguide, and the step of fitting the waveguide to the reflector as a function of this mark.

11 Claims, 3 Drawing Sheets

METHOD OF ASSEMBLING A RADIOCOMMUNICATION ANTENNA, RADIOCOMMUNICATION ANTENNA ASSEMBLED BY SUCH A METHOD, AND DEVICE ADAPTED TO IMPLEMENT SUCH AN ASSEMBLY METHOD

CROSS-REFERENCE TO RELATED APPLICATIONS

This application is based on French Patent Application No. FR 0553937 filed on Dec. 19, 2005, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a method of assembling a radiocommunication antenna, a radiocommunication antenna assembled by such a method, and a device adapted to implement such an assembly method.

2. Description of the Prior Art

A radiocommunication antenna 10 (FIG. 1) may comprise a main reflector 12 the shape whereof, for example that of a circular symmetry paraboloid, focuses the received or transmitted electromagnetic waves at a subreflector 14.

That subreflector 14 is connected to the feeder device 11 of the antenna 10 via a waveguide 16 of generally circular section.

Such a circular section waveguide 16 may have imperfections that cause a modification of the plane of propagation of a polarized electromagnetic field transmitted by the waveguide, as explained hereinafter with the assistance of FIG. 2*a*.

FIG. 2*a* is a front view of the waveguide 16 described above, this representation foregrounding the elliptical shape of certain sections of the waveguide 16.

These elliptical sections cause an offset between the plane of propagation of a polarized electromagnetic field 17 entering the guide 16 and the plane of propagation of the electromagnetic field 18 leaving the guide 16.

Such an offset between the planes of propagation of the electromagnetic fields entering and leaving the guide is undesirable since it may cause interference between adjacent antennas. In fact, each antenna is defined by an 'ideal' transmission plan along which the transmitted signals theoretically propagate, the use of this ideal plane enabling different adjacent antennas to be allocated separate propagation planes in order to limit the interference between antennas.

Consequently, the offset introduced by a waveguide in the plane of propagation of a polarized electromagnetic field can limit the number of antennas that may be placed in the same vicinity.

This is why an antenna manufacturer is obliged to limit the offset of the plane of propagation of the polarized electromagnetic field transmitted, which offset can be evaluated by a parameter such as the transverse discrimination of the antenna, also called the cross polar discrimination (XPD).

More precisely, the XPD of an antenna fed by a plane electromagnetic field corresponds to the ratio in dB between the power Pc transmitted by the antenna in the component coplanar with the electromagnetic field provided and the power Pt transmitted by the antenna in the component transverse to, i.e. at a right-angle or 90° to, the electromagnetic field supplied, in accordance with the following formula:

$$G=-10\log(Pc/Pt)$$

these powers being measured over a particular angular aperture as a function of the standards concerned.

To limit the offset introduced by a waveguide, it is known to use precise, and therefore long and costly, machining techniques so that the imperfections of the waveguide are limited.

The present invention results from the observation that a circular section waveguide in practice, and despite its imperfections, exhibits circular symmetry about its longitudinal axis and, because of this, it is possible to fix the waveguide to a reflector at any position obtained by pivoting the cylindrical waveguide relative to its longitudinal axis.

The invention is also a result of the observation that, as described hereinafter with the assistance of FIG. 2*b*, the offset electromagnetic field 18 may be considered as the sum of an electromagnetic field 18*a* propagating in a plane coplanar with the incoming electromagnetic field and an electromagnetic field 18*b* propagating in a plane transverse to or perpendicular to that incoming electromagnetic field.

SUMMARY OF THE INVENTION

This is why the present invention relates to a method of assembling a radiocommunication antenna comprising a reflector connected to a subreflector via a circular section waveguide extending along a longitudinal axis, comprising the following steps:

- the step of pivoting the waveguide about its longitudinal axis to determine a position such that an offset of the plane of propagation of a polarized electromagnetic field transmitted by this guide is limited,
- the step of marking this position on the waveguide, and
- the step of fitting the waveguide to the reflector as a function of this mark.

Such a method optimizes the use of a circular section waveguide by enabling the fitting of the waveguide to a reflector at a position that minimizes the offset caused by the waveguide between the plane of propagation of the polarized electromagnetic field introduced into the guide and the plane of propagation of the polarized electromagnetic field leaving the guide.

This method is simple and quick to implement using a device of low cost. It enables the use of waveguides having a circular section with imperfections which, without this method, would introduce excessive offsets of the plane of propagation of the transmitted electromagnetic field and leading, for example, to an XPD incompatible with their application. Thus the cost of the waveguide and consequently of the antenna is reduced.

In one embodiment, the method further comprises the step of measuring a component of the electromagnetic field leaving the waveguide in a plane transverse to the plane of propagation of the polarized electromagnetic field entering the waveguide. It is therefore particularly simple to determine the offset caused by the waveguide.

In one embodiment, the method further comprises the step of measuring the offset caused by the waveguide by means of a transition guide between the circular section of the waveguide and a rectangular section. Such an embodiment enables the transition guide to be pivoted 90°, for example, to measure the transverse component of the electromagnetic field leaving the waveguide in one embodiment of the invention.

In one embodiment, the method further comprises the step of measuring the offset caused by the waveguide by comparing the power radiated at the exit from the waveguide in a plane with a power supplied to the entry of the waveguide.

The invention also relates to a radiocommunication antenna comprising a reflector connected to a subreflector via a waveguide having a circular section and extending along a longitudinal axis, and comprising a reference on the waveguide for determining a relative position of the waveguide vis-à-vis the reflector.

Such an antenna can limit the offset of the plane of propagation of an electromagnetic field when the latter is transmitted by the guide and the reference has been determined by one of the above embodiments of the method.

In one embodiment, the subreflector also comprises a mark for determining a position vis-à-vis the reflector for fitting the waveguide, thereby facilitating the fitting of the waveguide to the reflector.

The invention also relates to a device for assembling a radiocommunication antenna comprising a reflector connected to a subreflector via a circular section waveguide extending along a longitudinal axis, which device comprises:

means for pivoting the waveguide about its longitudinal axis and means for determining a position such that the plane of propagation of a polarized electromagnetic field transmitted by the waveguide is offset in limited fashion, and means for marking this position on the waveguide.

Such a device enables implementation of any of the above embodiments of the method.

In one embodiment, the device comprises means for measuring a component of the electromagnetic field leaving the waveguide in a plane transverse to the plane of propagation of the polarized electromagnetic wave entering the waveguide.

In one embodiment, the device comprises, at the exit of the waveguide, a transition guide between the circular section of the waveguide and a rectangular section. In this case, and in one embodiment, the device comprises means for pivoting the transition guide 90°.

In one embodiment, the device comprises means for comparing the power radiated at the exit of the waveguide, in a plane, with a power supplied at the entry of the waveguide.

Other features and advantages of the invention will become apparent in the light of the following description, given by way of illustrative and nonlimiting example, of embodiments of the invention referring to the appended figures.

DETAILED DESCRIPTION OF THE PREFERRED EMBODIMENT

In the figures described hereinafter, elements of the same kind or having the same function are identified by the same reference.

Figure 1:
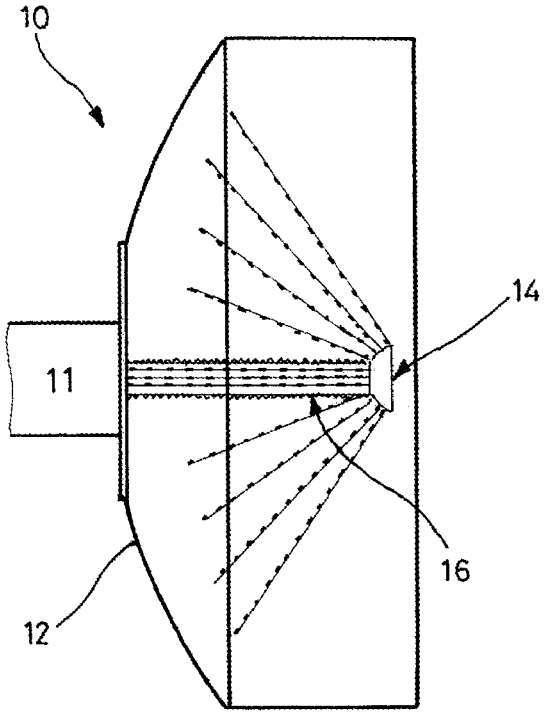
FIG. 1, already described, is a diagram representative of the elements guiding the electromagnetic waves in an antenna.
Figure 2A:
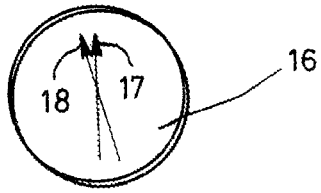
FIGS. 2*a* and 2*b*, already described, represent the offset introduced in the plane of propagation of a polarized electromagnetic field transmitted by a circular section waveguide.
Figure 2B:
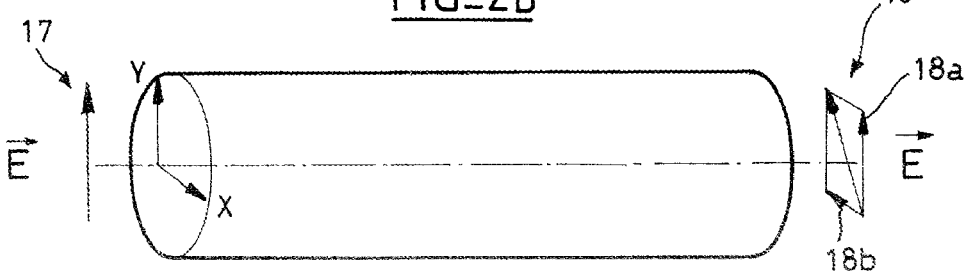
Figure 3:
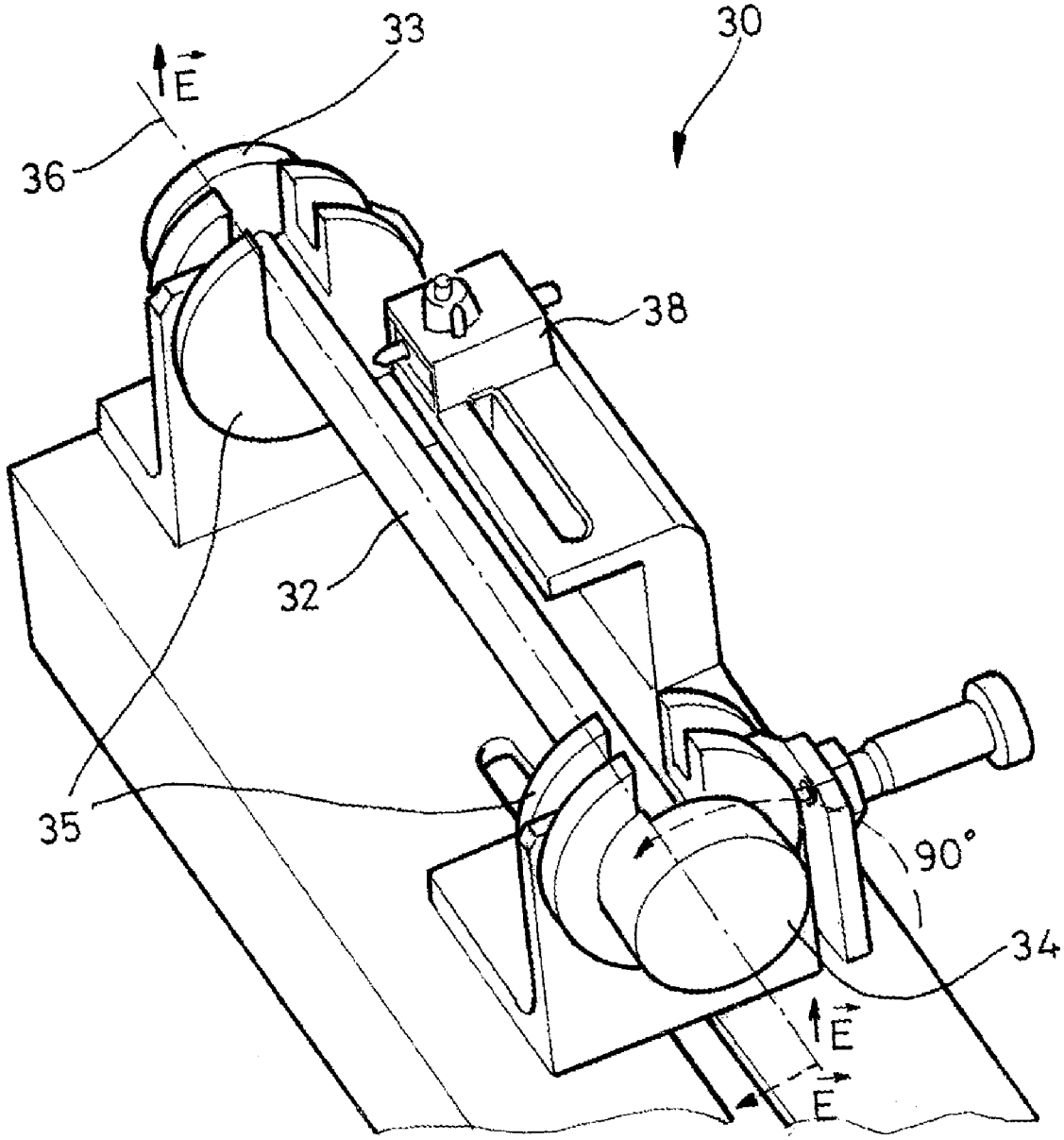
FIG. 3 represents a device for implementing a method according to the invention.
Figure 4A:
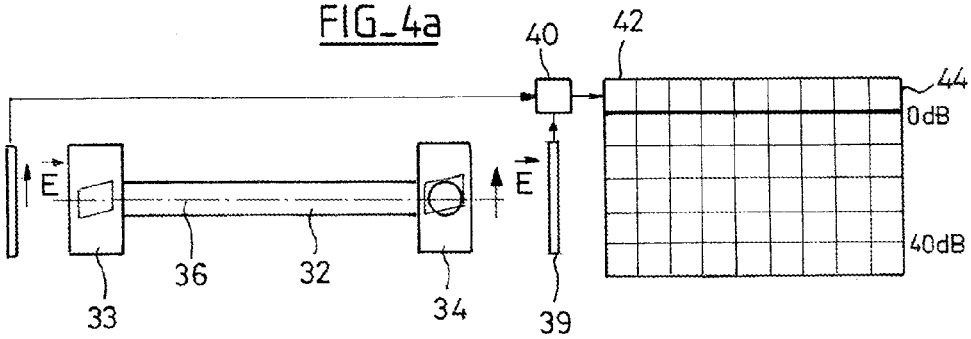
FIGS. 4*a*, 4*b*, 4*c* and 4*d* represent various steps of a method according to the invention using the device described with reference to FIG. 3.
Figure 4B:
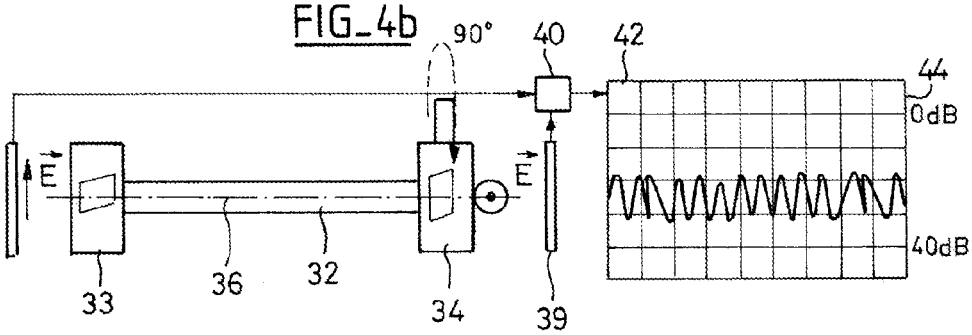
Figure 4C:
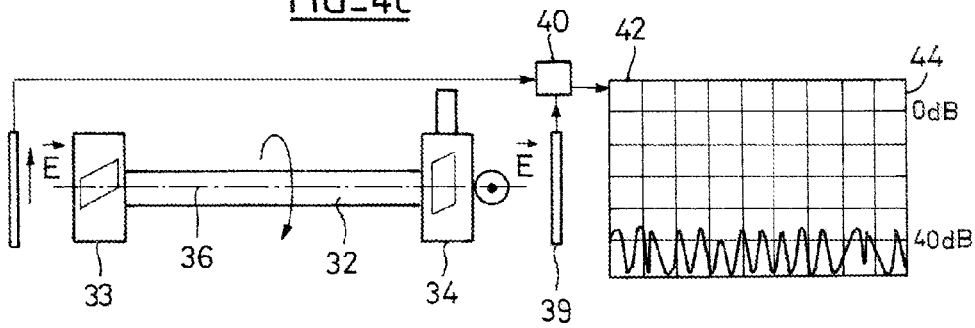
Figure 4D:
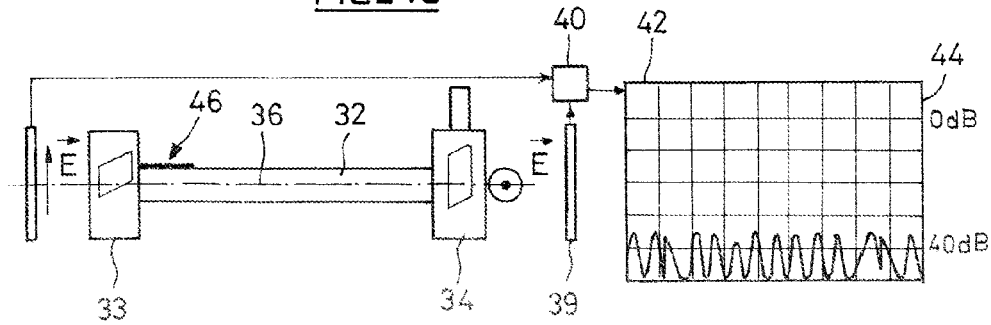

FIG. 3 represents a device 30 for determining a position of a waveguide 32 that minimizes the offsetting of the plane of propagation of a polarized electromagnetic field supplied to the waveguide 32, this position of the guide being determined relative to this entry propagation plane.

To this end, the device 30 comprises, in this embodiment, two guides 33 and 34 making the transition between a rectangular section and a circular section, these transition guides 33 and 34 being situated at each end of the circular waveguide 32.

On the one hand, the transition guide 33 is used to supply the electromagnetic field E entering the waveguide 32 in a particular propagation plane.

On the other hand, the transition guide 34 is used to obtain only one component of the electromagnetic field E leaving the waveguide 32 in a detection plane determined by the orientation of the transition guide 34.

To vary this detection plane, the device 30 also includes means 35, such as U-shaped supports, for pivoting or turning the waveguide 32 relative to the axis of circular symmetry of the waveguide 32, also referred to hereinafter as the longitudinal axis 36.

These U-shaped supports 35 enable the waveguide 32 to be rotated without modifying the orientation of the transition guides 33 and 34. They also enable the transition guide 34 to be pivoted with the waveguide 32 remaining fixed.

Finally, the device 30 comprises means 38, such as a metal stylus, for making a mark on the waveguide 32, this mark identifying the optimum position of the guide 32 relative to the transition guide 33 or its corollary, the plane of propagation of the polarized electromagnetic field introduced via this transition guide 33.

According to the invention, this optimum position is determined by measuring the component of the electromagnetic field leaving the guide 32 that propagates in a plane transverse to, or perpendicular to, the plane of propagation of the electromagnetic field introduced into the guide 32.

To this end, this transverse component is measured for different positions of the waveguide relative to the transition guide 32, those positions being obtained by turning the latter about its longitudinal axis 36 as described hereinafter with the assistance of FIGS. 4*a*, 4*b*, 4*c* and 4*d*.

Those figures represent the waveguide 32, its longitudinal axis 36 and the transition guides 33 and 34 situated at the entry and the exit of the waveguide 32, respectively.

During the first step (FIG. 4*a*), the device 30 measures the component of the electromagnetic field E leaving the guide 32 coplanar with the electromagnetic field E supplied to the waveguide 32.

To this end, the transition guides 33 and 34 are symmetrical relative to the waveguide 32 and a probe 39 supplies a signal representative of the power of the radiation leaving the guide, which power can be compared via a comparator 40 with the power measured at the entry of the guide 32.

The result of the comparison is displayed on a screen 42 representing, in dB, the result of this comparison along the ordinate axis 44.

During a second step, the transition guide 34 is tilted 90° (FIG. 4*b*) so that only the transverse component of the electromagnetic field E is transmitted by the transition guide 34.

The comparator 40 then supplies a signal representative of the power associated with this transverse component of the electromagnetic field E leaving the waveguide.

Thanks to such a signal, it is possible to determine (FIG. 4*c*) the position of the waveguide that minimizes this transverse component by pivoting the guide 32 relative to its axis 36 whilst at the same time observing on the screen 42 the power associated with the transverse component of the electromagnetic field leaving the guide 32.

When the position of the guide minimizing the transverse field E has been identified, the waveguide is marked with a reference 46 for identifying the relative position on a reflector that the guide 32 should have vis-à-vis the plane of propagation of the incoming electromagnetic field.

In fact, the reference or mark 46 represents the optimum position of the guide 32 relative to the plane of propagation of the electromagnetic field E supplied to the guide so that this plane of propagation of the incoming electromagnetic field can also be identified on the reflector by a second reference or mark in order to enable the waveguide to be fitted to the reflector with the assistance of these two marks.

There is claimed:

1. A method of assembling a radiocommunication antenna comprising a reflector connected to a subreflector via a circular section waveguide extending along a longitudinal axis, comprising the following steps:

the step of pivoting the waveguide about its longitudinal axis to determine a position such that an offset of the plane of propagation of a polarized electromagnetic field transmitted by this guide is limited, the step of marking this position on the waveguide, and the step of fitting the waveguide to the reflector as a function of this mark.

2. A method according to claim 1, further comprising the step of measuring a component of the electromagnetic field leaving the waveguide in a plane transverse to the plane of propagation of the polarized electromagnetic field entering the waveguide.

3. A method according to claim 2, further comprising the step of measuring the offset caused by the waveguide by means of a transition guide between the circular section of the waveguide and a rectangular section.

4. A method according to claim 3, further comprising the step of pivoting the transition guide 90° to measure the transverse component of the electromagnetic field leaving the waveguide.

5. A method according to any one of claims 2, 3 or 4, further comprising the step of measuring the offset caused by the waveguide by comparing the power radiated at the exit from the waveguide in the transverse plane with a power supplied to the entry of the waveguide.

6. A radiocommunication antenna comprising a reflector connected to a subreflector via a waveguide having a circular section and extending along a longitudinal axis, said antenna comprising a reference on the waveguide for determining a relative position of the waveguide relative to the reflector, wherein the reflector comprises a mark for determining a fitting position of the waveguide relative to the reflector.

7. A device for assembling a radiocommunication antenna comprising a reflector connected to a subreflector via a circular section waveguide extending along a longitudinal axis, comprising:

means for pivoting the waveguide about its longitudinal axis and means for determining a position such that the plane of propagation of a polarized electromagnetic field transmitted by the waveguide is offset in limited fashion, and means for marking this position on the waveguide.

8. A device according to claim 7, including means for measuring a component of the electromagnetic field leaving the waveguide transverse to the plane of propagation of the polarized electromagnetic wave entering the waveguide.

9. A device according to claim 7, including, at the exit of the waveguide, a transition guide between the circular section of the waveguide and a rectangular section.

10. A device according to claim 9 including means for pivoting the transition guide 90°.

11. A device according to claim 7, including means for comparing the power radiated at the exit of the waveguide, in a plane, with a power supplied at the entry of the waveguide.

* * * * *